US005123550A

United States Patent [19]

Nødskov et al.

[11] Patent Number: 5,123,550

[45] Date of Patent: Jun. 23, 1992

[54] COLLAPSIBLE LIGHT-WEIGHT FRAMEWORK FOR EXHIBITION USE

[76] Inventors: Preben Nødskov, 5 Thyravej, DK-2960 Rungsted Kyst; Hans J. Tolbøll, 1 Elsdyrvej, DK-2970 Høsholm, both of Denmark

[21] Appl. No.: 573,168

[22] PCT Filed: Mar. 21, 1989

[86] PCT No.: PCT/DK89/00062

§ 371 Date: Nov. 9, 1990

§ 102(e) Date: Nov. 9, 1990

[87] PCT Pub. No.: WO89/09006

PCT Pub. Date: Oct. 5, 1989

[30] Foreign Application Priority Data

Mar. 23, 1988 [DK] Denmark ..... 1588/88

[51] Int. Cl.[5] ..... A47F 5/00

[52] U.S. Cl. ..... 211/189; 52/109; 52/646; 248/166; 211/182

[58] Field of Search ..... 248/166; 211/189, 182; 52/646, 109, 655; 40/610; 160/135

[56] References Cited

U.S. PATENT DOCUMENTS

| | | | |
|---|---|---|---|
| 3,381,923 | 5/1968 | Berry | 248/166 |
| 4,276,726 | 7/1981 | Derus | 248/166 X |
| 4,512,097 | 4/1985 | Zeigler | 52/109 X |
| 4,561,618 | 12/1985 | Zeigler | 248/166 |
| 4,579,066 | 4/1986 | Zeigler | 248/166 X |
| 4,658,560 | 4/1987 | Beaulieu | 248/166 X |
| 4,663,899 | 5/1987 | Nodskov et al. | 52/646 X |
| 4,730,739 | 3/1988 | Semerau | 211/189 |
| 4,970,841 | 11/1990 | Zeigler | 160/135 X |
| 5,016,418 | 5/1991 | Rhodes | 52/646 |

*Primary Examiner*—Robert W. Gibson, Jr.

*Attorney, Agent, or Firm*—Rothwell, Figg, Ernst & Kurz

[57] ABSTRACT

In a collapsible lightweight framework for display use and of the type composed of square modules disposed in side-by-side and/or superposed relationship and consisting of articulated rods, whose ends are pivotally connected with corner joints (5 to 12) provided with a substantially plane front plate (15) with parallel edge portions (28, 29) for engagement with longitudinal parallel guideways (35, 36) in a releasable rail member (14).

The rail member (14) allowing for the suspension of shelves, trays and the like, may thus be designed with an improved stiffening effect and simultaneously for easily releasable securing to the corner joints.

10 Claims, 2 Drawing Sheets

COLLAPSIBLE LIGHT-WEIGHT FRAMEWORK FOR EXHIBITION USE

Figure 1:
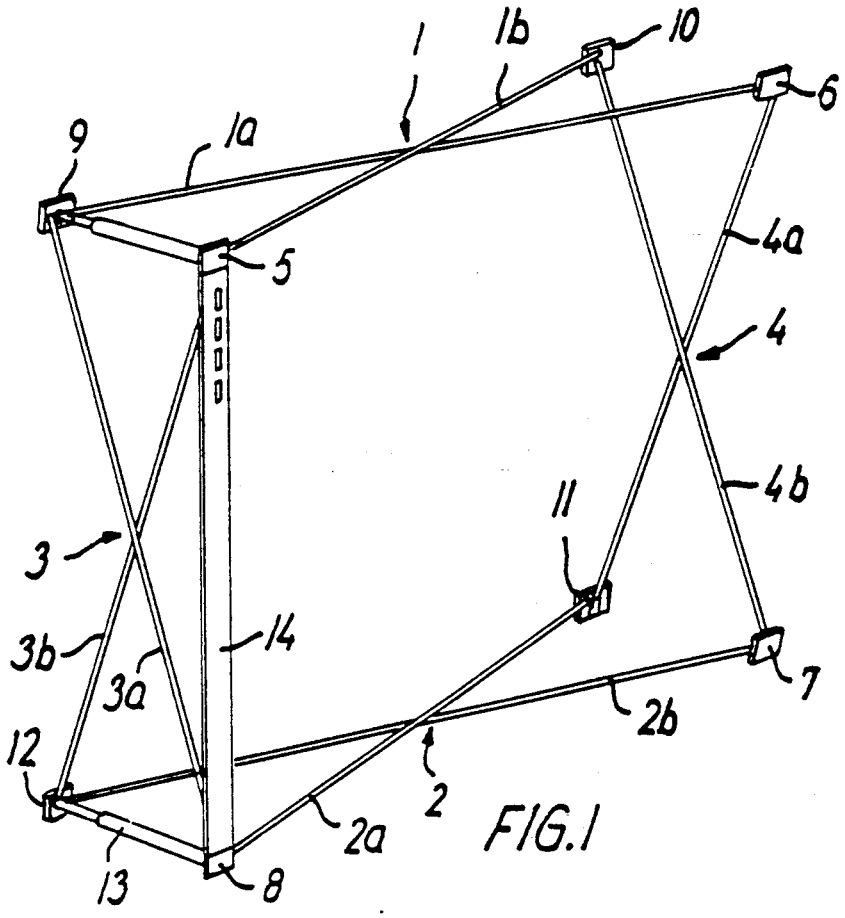

The invention relates to a collapsible lightweight stand or framework, in particular for display purposes, and of the type composed of substantially square modules disposed in side-by-side and/or superposed relationship and consisting of articulated rods, said modules being individually designed as a boxlike frame having two opposite vertical, substantially parallel module faces and horizontal and vertical lateral faces individually constituted by a scissors-like pair of articulated rods whose ends are pivotally connected with corner joints disposed at one and the other of said module faces, which corner joints at one or both module faces may be common to adjacent modules positioned in side-by-side or superposed relationship, each corner joint being provided with a substantially plane front plate which at its rear side is connected with bearing means for receiving the ends of the articulated rods, said front plate having parallel side edges vertical in the erected condition of the framework.

In DK published patent application No. 148,673B a stand of the above type is disclosed, the individual modules of which in the erected condition, in addition to four scissors-like sets of articulated rods constituting the vertical and horizontal faces of the module, include two sets of diagonally directed rods extending individually from the four corner joints at one module face to a central joint, the rods of the two diagonal sets of rods in a scissors-like manner intersecting each other pairwise, just like the rods of the horizontal and vertical lateral faces. This prior stand is characterized, inter alia, by a symmetrical structure of the modules, thereby obtaining, on one hand, an improved flexibility as regards the adaptation of the framework to the actual conditions on an exhibition site and, on the other hand, advantages in respect of load capability and a reduction of the risk of deformation when erecting and collapsing the framework, and at the same time both module faces may be used for suspending posters.

From GB-A 2181291 a collapsible display stand is known in which each corner joint or node comprises a substantially plane plate having one or more pairs of lugs at its rear side for receiving the ends of the articulated rods of this framework and where each front plate has parallel side edges which are vertical in the erected condition of the framework.

While the use of said prior stand is mainly restricted to the suspension of display posters by suspension means secured to the corner joints at one module face, DK patent application No. 5013/87 discloses a framework design allowing for an extended field of application and a simplification of the modular structure since, inter alia, the use of diagonal rod sets in most cases may be completely avoided. In said prior framework two corner joints in side-by-side or superposed relationship at the same module face are connected via a rail member which at the ends is pivotally connected with the actual corner joints and includes two halves pivotally connected in the middle of the rail element. Thereby, the two halves may effect a pivoting movement with respect to each other between a first position in which, in the erected condition of the framework, they are in substantially linear alignment of each other, and a second position in which, in the collapsed condition of the framework, they are folded together with the pivotal connection in the middle of the rail member displaced in the direction towards the point of intersection of the scissors-like pair of articulated rods of the vertical or horizontal lateral face located therebehind.

By providing one or more modules of the framework with such mounting rails which, in the erected condition of the framework, extend in the plane of one of the module faces, it has been made possible for the purpose of displaying three-dimensional objects to suspend shelves, trays or the like on the stand, in that the mounting rail may without difficulty be designed to support such items.

It is an object of the present invention to provide a further development of the latter framework design including an improved stiffening effect of said rail elements and an easily releasable securing of them to superposed corner joints in the erected framework.

According to the invention, this is obtained in that said front plate is provided at said parallel side edges with edge portions designed to engage longitudinal parallel guideways in a rail member designed to releasably connect superposed corner joints, and with abutments for the ends of the guideways of the rail member.

By providing the corner joints of the framework and the rail member with such guide means for mutual engagement, a rail member in a non-pivotal design and with an increased rigidity may be mounted without difficulty in the erected condition of the framework.

In a preferred embodiment the rail member may be a substantially flat member with edge portions bent in U-shape at the longitudinal side edges for the provision of said guideways.

In the same manner as the framework design according to the above mentioned patent application the framework according to the invention may be designed such that a number of rail members serve as the sole locking means for securing the framework in its erected condition, thereby also obtaining a fully sufficient rigidity of the framework without use of diagonal rod sets.

However, means are preferably provided for securing the framework in the erected condition, e.g. in the form of locking means of the type disclosed in the above Danish published patent application, and said abutments may then be disposed asymmetrically on the parallel vertical side edges of the corner joints, the guideways of the rail member having then a length corresponding to the distance between the abutment at a side edge of the upper of two superposed corner joints and the upper end of the corresponding side edge of the subjacent corner joint.

Figure 2:
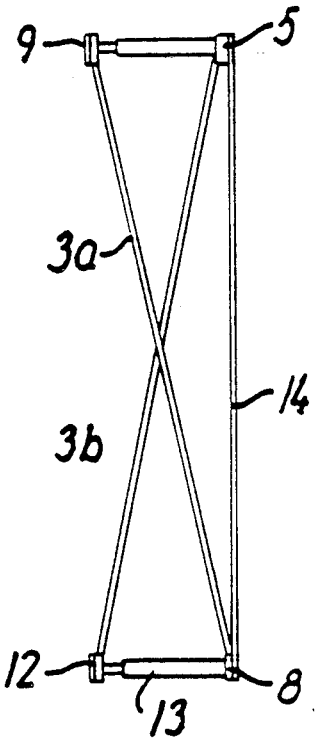
Figure 3:
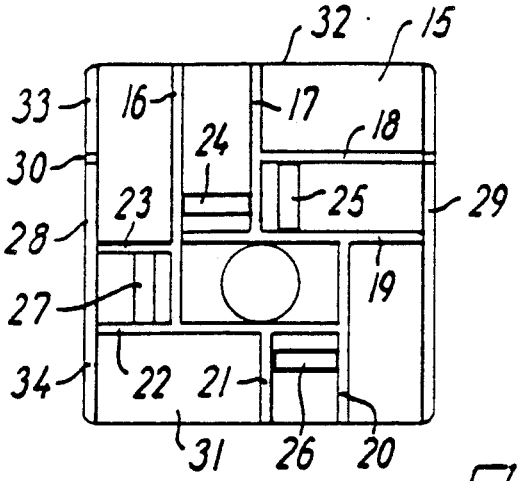
Figure 4:
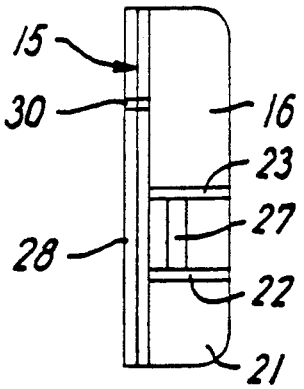
Figure 5:
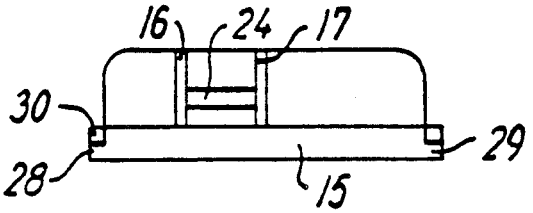
Figure 6:
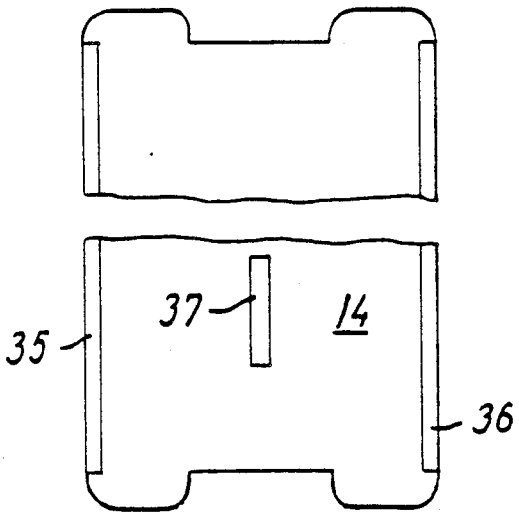
Figure 7:
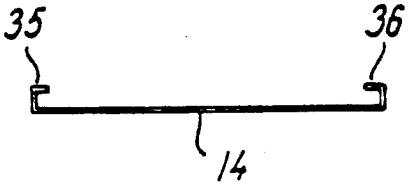

The invention will now be explained in more detail with reference to the drawings, in which FIGS. 1 and 2 illustrate a single module in an embodiment of a lightweight display framework according to the invention in a perspective and a lateral elevation, respectively, FIGS. 3, 4 and 5 illustrate a corner joint of the framework viewed in rear, lateral and top elevations, respectively, and FIGS. 6 and 7 show a rail member viewed in rear and cross-sectional elevations.

The framework module shown in FIGS. 1 and 2 in the erected condition is formed as a box-like frame as known from the above published patent application No. 148 673 B. The opposite horizontal and vertical lateral faces 1, 2 and 3, 4, respectively, are individually formed by two equally long rods designated 1*a* and 1*b* for lateral face 1, and in a similar manner for the remaining lateral faces. The two rods of each lateral face are centrally articulated in a scissors-like manner. Each of rods 1*a*, 1*b* . . . 4*a*, 4*b* which are preferably constituted by comparatively thin-walled tubes of aluminium having an outer diameter of e.g. 10 mm, is pivotally connected at its ends with corner joints at one and the other of the substantially flat parallel modular faces.

Rods 1*b* and 3*b*, rods 1*a* and 4*a*, rods 2*b* and 4*b* and rods 2*a* and 3*a*, respectively, are in this manner pivotally connected with the corner joints 5, 6, 7 and 8 at the front face of the module. Rods 1*a* and 3*a*, rods 1*b* and 4*b*, rods 2*a* and 4*a* and rods 2*b* and 3*b*, respectively, are similarly pivotally connected with the corner joints 9, 10, 11 and 12 at the rear of the module.

Each pivotal connection between two rods for the provision of a scissors-like pair of rods may be formed in a manner known per se, e.g. by means of pins, rivets and the like.

By assembling the illustrated framework module with a number of similar modules into a framework configuration, some of the corner joint links 5 to 12 will be connected with corner joint links of one or more neighbouring modules so that one or more of the lateral faces 1 to 4 of the module will be common to two adjacent modules.

In order to allow for a simple and quick locking in the illustrated erected condition a releasable locking means 13 constitutes a rigid connection of one or more pairs of opposite corner joints, e.g. corner joints 8 and 12 in FIG. 1.

As it appears from FIGS. 3 to 5, corner joints 5 to 12 are designed in such a manner that two superposed corner joints, e.g. corner joints 5 and 8 in FIG. 1, may be connected by means of a rigid rail member 14 which in a simple manner may be mounted in the erected condition of the framework after corner joints 8 and 12 are connected by means of the releasable locking means 13.

More specifically each corner joint includes a front plate 15 which in the illustrated embodiment is integral with the bearing means for the ends of upto four rods connected with the acual corner joint, said bearing means being formed by rearwardly directed wall portions 16 to 17, 18 to 19, 20 to 21 and 22 to 23 and being provided, for the purpose of pivotal journalling of the rod ends, with pins 24 to 27 that may be releasably positioned in the wall portions associated with each bearing means.

At its parallel vertical side edges front plate 15 is provided with edge portions 28 and 29 with decreased thickness so as to be insertable into guideways in a rail member as illustrated in FIGS. 6 and 7, and at each of the edge portions 28 and 29 an abutment 30 is provided for the end of the guide ways of the rail member.

In the illustrated embodiment the abutment 30 is asymmetrically positioned at a distance from the lower edge 31 of the front plate 15 which may for instance be about three times as large as the distance from the upper edge 32. Abutments 30 thus divide each of the edge portions 28 and 29 into an upper portion 33 and a lower portion 34, the latter of which is for instance three times as long as the upper portion.

For providing guideways adapted to the edge portions 28 and 29 of the corner joints rail member 14 is designed at its longitudinal side edges with edge portions 35 and 36 bent in U-shape, and in the illustrated embodiment rail member 14 has a length shorter than the distance from an abutment 30 on the upper of two superposed corner joints of the framework module to the upper edge 32 of the subjacent corner joint, but larger than the distance from the lower edge 31 of the upper joint to the abutment 30 of the subjacent corner joint.

Rail member 14 which, as illustrated, may be provided with slits 37 for receiving hooks for shelves may thus be disposed in a simple manner on the framework module in FIG. 1 by pushing it from below on the upper corner joint link 5 until the upper edge of the bent edge portions 35 and 36 strikes abutment 30, following which the lower end of rail member 14 may be pushed from above onto the lower corner joint 8 and drop down by gravity onto the upper face of abutments 30 of said joint.

In view of the fact that the rail member 14 is a rigid element it is in itself able to serve as a stable locking means in the erected condition of the framework so that separate locking means as illustrated in 27 may be dispensed with.

Thereby, one or more rail members may have a length corresponding to the distance between abutments 30 of two superposed corner joints or one or more corner joints may be provided with a supplementary abutment at each of the edge portions 28 and 29 so that said two abutments at each edge portion are equally spaced apart from top edge 32 and lower edge 31, respectively.

Front plate 15 with edge portions 28 and 29 on the corner joints do not need to be integral with the rearwardly extending bearing means for the ends of the rods connected with the joint. Front plate 15 may be manufactured as a separate member to be disposed on corner joints in frameworks of a design known per se, e.g. stands of the type disclosed in the above mentioned published patent application, or stands which are retained in the erected position by means of internal stresses in the articulated rods of the framework modules.

Consequently, the invention also includes a combination of corner joints or associated front plates and rail members for connecting two superposed corner joints.

We claim:

1. A collapsible lightweight stand or framework, in particular for display purposes, and of the type composed of substantially square modules disposed in side-by-side and/or superposed relationship and consisting of articulated rods, said modules being individually designed as a boxlike frame having two opposite vertical, substantially parallel module faces and horizontal and vertical lateral faces (1 to 4) individually constituted by a scissors-like pair of articulated rods (1*a*, 1*b* . . . 4*a*, 4*b*) whose ends are pivotally connected on corner joints (5 to 12) disposed at one and the other of said module faces, which corner joints at one or both modules faces may be common to adjacent modules positioned in side-by-side or superposed relationship, each corner joint (5 to 12) being provided with a substantially plane front plate (15) which at its rear side is connected with bearing means (16 to 27) for receiving the ends of the articulated rods (1*a*, 1*b* . . . 4*a*, 4*b*), said front plate (15) having parallel side edges vertical in the erected condition of the framework wherein said front plate is provided at said parallel side edges with edge portions (28, 29) designed to engage longitudinal parallel guideways (35, 36) in a rail member (14) designed to releasably connect superposed corner joints (5, 8) each corner joint being provided at said vertical side edges with abutments (30) for the ends of the guide ways (35, 36) of the rail member (14).

2. A framework as claimed in claim 1, wherein in that the rail member (14) is a substantially flat member with edge portions (35, 36) bent into U-shape at the longitudinal side edges for the provision of said guideways.

3. A framework as claimed in claim 1, wherein in that means (13) are provided for retaining the framework in the erected condition, and in that said abutments (30) are asymmetrically disposed on said parallel vertical side edges of the corner joints (5 to 12), the guideways (35, 36) of the rail member (14) having a length corresponding in the erected condition of the framework to the distance between the abutment (30) at a side edge of the upper (5) of two superposed corner joints (58) and the upper end of the corresponding side edge of the subjacent corner joint (8).

4. A framework as claimed in claim 1, wherein the rail member (14) is designed to support displaying units that have engagement members for engaging the rail member (14).

5. A framework as claimed in claim 2 wherein means (13) are provided for retaining the framework in the erected condition, and in that said abutments (30) are asymmetrically disposed on said parallel vertical side edges of the corner joints (5 to 12), the guideways (35, 36) of the rail member (14) having a length corresponding in the erected condition of the framework to the distance between the abutment (30) at a side edge of the upper (5) of two superposed corner joints (58) and the upper end of the corresponding side edge of the subjacent corner joint (8).

6. A framework as claimed in claim 2 wherein the rail member (14) is designed to support displaying units.

7. A framework as claimed in claim 3 wherein the rail member (14) is designed to support displaying units.

8. A framework as claimed in claim 4, wherein said displaying units are shelves or trays.

9. A framework as claimed in claim 6, wherein said displaying units are shelves or trays.

10. A framework as claimed in claim 7, wherein said displaying units are shelves or trays.

* * * * *